US010178878B2

(12) United States Patent
Camus et al.

(10) Patent No.: US 10,178,878 B2
(45) **Date of Patent: *Jan. 15, 2019**

(54) SMOKING ARTICLE INCLUDING A LIQUID DELIVERY MEMBER AND A WRAPPER

(71) Applicant: PHILIP MORRIS PRODUCTS S.A., Neuchatel (CH)

(72) Inventors: Alexandre Camus, Colombier (CH); Christophe Blanc, Le Mont-sur Lausanne (CH)

(73) Assignee: Philip Morris Products S.A., Neuchatel (CH)

( * ) Notice: Subject to any disclaimer, the term of this patent is extended or adjusted under 35 U.S.C. 154(b) by 175 days.

This patent is subject to a terminal disclaimer.

(21) Appl. No.: 14/787,822

(22) PCT Filed: May 14, 2014

(86) PCT No.: PCT/EP2014/059838
§ 371 (c)(1),
(2) Date: Oct. 29, 2015

(87) PCT Pub. No.: WO2014/185239
PCT Pub. Date: Nov. 20, 2014

(65) Prior Publication Data

US 2016/0143348 A1 May 26, 2016

(30) Foreign Application Priority Data

May 14, 2013 (EP) ..... 13167637

(51) Int. Cl.
*A24D 1/02* (2006.01)
*A24D 1/00* (2006.01)
(Continued)

(52) U.S. Cl.
CPC ..... *A24D 1/002* (2013.01); *A24D 1/02* (2013.01); *A24D 1/025* (2013.01); *A24D 3/048* (2013.01); *A24D 3/061* (2013.01); *A24F 47/006* (2013.01)

(58) Field of Classification Search
CPC ..... A24D 1/025; A24D 3/048; A24D 3/061
See application file for complete search history.

(56) References Cited

U.S. PATENT DOCUMENTS 5,396,910 A * 3/1995 Casey, III ..... A24D 3/043 131/336
8,262,550 B2 9/2012 Barnes
(Continued)

FOREIGN PATENT DOCUMENTS

CN 1570274 1/2005
CN 102365034 2/2012
(Continued)

OTHER PUBLICATIONS

PCT Search Report and Written Opinion for PCT/EP2014/059838 dated Jun. 12, 2014 (8 pages).
(Continued)

*Primary Examiner* — Eric Yaary
(74) *Attorney, Agent, or Firm* — Mueting, Raasch & Gebhardt, P.A.

(57) ABSTRACT

There is provided a smoking article comprising an aerosol forming substrate, a mouthpiece axially aligned with the aerosol forming substrate, a liquid delivery member and a wrapper surrounding at least a portion of the smoking article. The liquid delivery member is disposed in the aerosol forming substrate or in the mouthpiece, and comprises structural material releasably enclosing liquid. The wrapper includes at least one area permeable to the liquid and at least one area impermeable to the liquid. At least a portion of the at least one permeable area is aligned with or
(Continued)

Figure 1:
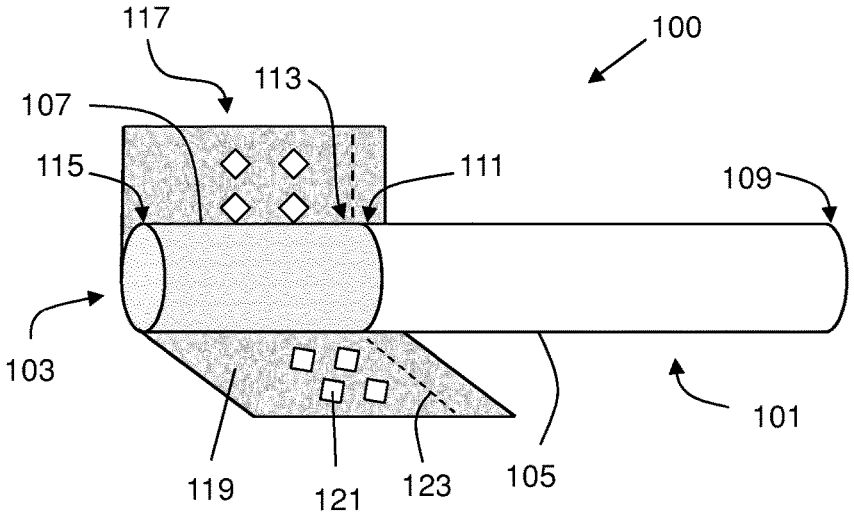

downstream of the liquid delivery member. When the liquid is released from the liquid delivery member, the liquid can migrate to the outer surface of the smoking article via the permeable area or areas of the wrapper.

19 Claims, 1 Drawing Sheet

(51) Int. Cl.

| | |
|---|---|
| ***A24D 3/06*** | (2006.01) |
| ***A24D 3/04*** | (2006.01) |
| ***A24F 47/00*** | (2006.01) |

(56) References Cited

U.S. PATENT DOCUMENTS

| | | | | |
|---|---|---|---|---|
| 8,613,284 | B2 | 12/2013 | Hutchens | |
| 2006/0112964 | A1 | 6/2006 | Jupe | |
| 2007/0034545 | A1* | 2/2007 | Sabalaskey | B65D 25/205 206/575 |
| 2007/0095357 | A1 | 5/2007 | Besso | |
| 2008/0302373 | A1* | 12/2008 | Stokes | A24D 3/0216 131/84.1 |
| 2009/0288669 | A1* | 11/2009 | Hutchens | A24D 3/0212 131/274 |
| 2010/0236561 | A1 | 9/2010 | Barnes | |
| 2011/0232659 | A1 | 9/2011 | Ercelebi | |
| 2013/0047999 | A1* | 2/2013 | Rushforth | A24D 3/068 131/332 |
| 2013/0081644 | A1 | 4/2013 | Noda | |
| 2014/0137880 | A1 | 5/2014 | Zitturi | |

FOREIGN PATENT DOCUMENTS

| | | |
|---|---|---|
| CN | 102404999 | 4/2012 |
| CN | 102669817 | 9/2012 |
| CN | 102781265 | 11/2012 |
| EP | 1891866 | 2/2008 |
| EP | 2578093 | 4/2013 |
| EP | 2692252 | 2/2014 |
| GB | 2427815 | 1/2007 |
| JP | 2012/520680 | 9/2012 |
| JP | 2013/31437 | 2/2013 |
| JP | 2013/055887 | 3/2013 |
| RU | 107025 U1 | 8/2011 |
| WO | WO 2010/051076 | 5/2010 |
| WO | WO 2011/117733 | 9/2011 |
| WO | WO 2011/117734 | 9/2011 |
| WO | WO 2011/152316 | 12/2011 |
| WO | WO 2012/132009 | 10/2012 |
| WO | WO 2013/013786 | 1/2013 |
| WO | WO 2013/020280 | 2/2013 |
| WO | WO 2014/128973 | 8/2014 |

OTHER PUBLICATIONS

Extended European Search Report for Application No. 13167637.1 dated Oct. 31, 2013 (5 pages).

Notice of Allowance and Search Report issued in Russia for Application No. 2015153058 dated Apr. 6, 2018 (15 pages). English translation included.

Office Action issued in Taiwan for Application No. 103116718 dated Jul. 17, 2018 (11 pages).

Office Action issued in China for Application No. 201480027330.8 dated Jul. 3, 2018 (20 pages). English translation included.

* cited by examiner

SMOKING ARTICLE INCLUDING A LIQUID DELIVERY MEMBER AND A WRAPPER

This application is a U.S. National Stage Application of International Application No. PCT/EP2014/059838, filed May 14, 2014, which was published in English on Nov. 20, 2014 as International Patent Publication WO 2014/184239 A1. International Application No. PCT/EP2014/059838 claims priority to European Application No. 13167637.1 filed May 14, 2013.

The present invention relates to a smoking article having a liquid delivery member disposed therein, and a wrapper.

Smoking articles, particularly cigarettes, generally comprise a filter aligned in end-to-end relationship with a shredded tobacco rod or another aerosol forming substrate. Typically, the filter includes a plug of cellulose acetate tow attached to the tobacco rod by tipping paper. A cigarette is employed by a consumer by lighting one end thereof and burning the shredded tobacco rod. The consumer receives mainstream smoke by drawing on the opposite end (mouth end or filter end) of the cigarette. Ventilation of the mainstream smoke can be achieved with a row or rows of perforations in the tipping paper about a location along the filter. Other known smoking articles include smoking articles in which tobacco material is heated, rather than combusted, to form an aerosol, and smoking articles in which a nicotine-containing aerosol is generated from tobacco material, tobacco extract, or other nicotine source, without combustion or heating.

Smoking articles including flavourants that are released into the mainstream smoke of the smoking article during combustion, in order to modify the smoking characteristics thereof, are known in the art. In addition, smoking articles which include flavourants on the outer surface of the smoking article, for example for contact with a consumer's mouth or fingers, are also known. For example, in a filter cigarette comprising a tobacco rod, a filter, and tipping paper attaching the tobacco rod and filter, the surface of the tipping paper may be coated with a solution of cells having at least one flavourant encapsulated therein. When the filter cigarette is placed in a consumer's mouth, moisture from the consumer's saliva causes the cells on the surface of the tipping paper to release the encapsulated flavour.

It would be desirable to provide an improved smoking article and filter for a smoking article that provide flavour, or another sensory effect for a consumer, on the outer surface of the smoking article.

According to a first aspect of the invention, there is provided a smoking article comprising: an aerosol forming substrate; a mouthpiece axially aligned with the aerosol forming substrate; a liquid delivery member disposed in the aerosol forming substrate or in the mouthpiece, the liquid delivery member comprising structural material releasably enclosing liquid; and a wrapper surrounding at least a portion of the smoking article, wherein the wrapper includes at least one area permeable to the liquid and at least one area impermeable to the liquid, and wherein at least a portion of the at least one permeable area is aligned with or downstream of the liquid delivery member.

The term "liquid delivery member" refers to any delivery system for delivering a liquid, in this case comprising structural material releasably enclosing a liquid or liquids. The liquid may comprise any suitable substance, but preferably comprises liquid flavourant. Preferably, the liquid flavourant is suitable for imparting a flavour onto a consumer's skin, for example the consumer's fingers. The liquid delivery member is preferably arranged to release at least a portion of the liquid when the smoking article is subject to external force. The external force may be applied, and hence the liquid released, before, during or after smoking. The liquid is able to migrate through the permeable area or areas of the wrapper, for example to release flavour onto the fingers of a consumer. Alternatively, the liquid delivery member may be arranged to release at least a portion of the liquid in response to another type of trigger, for example, when the liquid delivery member is heated or when the liquid delivery member undergoes a chemical reaction with another smoking article component.

Provision of a liquid delivery member allows a consumer to release the liquid when desired. This reduces the chance of the liquid migrating or disintegrating at other times, for example, during storage. If the liquid comprises liquid flavourant, the flavour may be transferred to the consumer's fingers whenever desired by the consumer, for example, after smoking. The flavour is transferred to the consumer's fingers via the permeable areas of the wrapper. The liquid can migrate through those areas onto the consumer's skin. The area or areas on the outer surface of the smoking article where the liquid is transferred may be referred to as liquid transfer areas. Thus, the location of the liquid transfer areas can be set as desired, according to the pattern of permeable and impermeable areas of the wrapper. Because the liquid, for example liquid flavourant, is provided within the liquid delivery member disposed within the smoking article, rather than being provided on an outer surface of the smoking article, there is little risk that the liquid will be destroyed or damaged during manufacture or packaging.

The smoking article according to the present invention may comprise a filter cigarette, or another smoking article in which tobacco material of the aerosol forming substrate is combusted to form smoke. In that case, the aerosol forming substrate may comprise a tobacco rod and the mouthpiece may comprise a filter. Alternatively, tobacco material may be heated, rather than combusted, to form an aerosol. The smoking article may alternatively be one in which a nicotine-containing aerosol is generated from the aerosol forming substrate (for example, a tobacco material, tobacco extract, or other nicotine source) without combustion or heating. The term "smoking" used in this specification should be interpreted in a similarly broad manner.

In this specification, the terms "upstream" and "downstream" are used to describe relative positions between elements of the smoking article or mouthpiece in relation to the direction of mainstream smoke as it is drawn from a lit end of the smoking article through the mouthpiece. Mainstream smoke flows generally parallel to the length of the smoking article, in the longitudinal direction. The transverse direction of the smoking article is perpendicular to the longitudinal direction.

The liquid delivery member may be disposed in the aerosol forming substrate. In that case, preferably, the wrapper comprises a wrapper circumscribing the aerosol forming substrate. Thus, the liquid transfer areas are aligned with the aerosol forming substrate. However, in a preferred embodiment, the liquid delivery member is disposed in the mouthpiece. Thus, the liquid transfer areas are aligned with the mouthpiece. This may be particularly advantageous when the liquid delivery member comprises liquid flavourant, since this enhances transfer of the flavour onto a consumer's fingers, because the consumer is most likely to touch the mouthpiece portion of the smoking article before and during smoking.

Preferably, the mouthpiece comprises a filter, and the wrapper may comprise a filter wrapper circumscribing the filter or a portion of the filter. Preferably, the mouthpiece comprises a filter and the aerosol forming substrate comprises a tobacco rod and the wrapper may comprise tipping material attaching the tobacco rod and the filter. The liquid delivery member may be embedded in filter material of the filter, for example in a plug of filter material, such as cellulose acetate tow. Alternatively, the liquid delivery member may be provided in a cavity within the filter, for example in a plug-space-plug filter.

In a preferred embodiment, the wrapper is partially coated with a coating impermeable to the liquid, such that the uncoated area or areas comprise the at least one area permeable to the liquid and the coated area or areas comprise the at least one area impermeable to the liquid.

The coating may be any coating suitable for rendering the wrapper impermeable to the liquid. Suitable coatings include, but are not limited to, nitrocellulose and ethylcellulose. The coating may be visible or invisible to the consumer. The term "coating" refers to a layer of any substance which extends partially across the wrapper. The layer may or may not be secured or attached to the wrapper. For example, the wrapper and coating may simply comprise two substantially parallel adjacent layers. The coating need not be applied to the wrapper in a distinct coating step. For example, the wrapper and coating may be formed simultaneously as substantially parallel layers. The uncoated area or areas may be formed by virtue of the design of the coating layer.

The coating may be on the inner surface or the outer surface of the wrapper. Preferably, however, the coating is on the inner surface of the wrapper. This is particularly advantageous if the wrapper is on the outermost surface of the smoking article. Providing the coating on the inner surface reduces the chance of the coating being damaged or partially removed during manufacture, packaging or handling.

Alternatively, the wrapper may comprise a die-cut or perforated impermeable material, wherein the cut or perforated area or areas comprise the at least one area permeable to the liquid and the uncut or unperforated area or areas comprise the at least one area impermeable to the liquid. The cut or perforated areas preferably comprise apertures completely surrounded by the wrapper material. Preferably, such a wrapper is used together with a low permeable filter plug wrap.

The smoking article typically comprises several wrappers. For example, if the aerosol forming substrate comprises a tobacco rod, the tobacco rod typically comprises a tobacco rod wrapper surrounding the tobacco material. If the mouthpiece comprises a filter, the filter typically comprises one or more filter wrappers surrounding the filter material. If the filter is a multi component filter comprising a plurality of filter segments, the filter may comprise a wrapper for each filter segment and a wrapper for the whole filter. The smoking article typically comprises tipping material surrounding the smoking article and attaching the tobacco rod and the filter. The wrapper having at least one area permeable to the liquid and at least one area impermeable to the liquid may comprise the tobacco rod wrapper, one of the filter wrappers, the tipping material, or another wrapper. The wrapper is preferably porous. The wrapper may comprise paper or any other cellulose based material, such as cellulose film or cellulose diacetate film.

If other wrappers are provided over or under the wrapper, those wrappers should be permeable to the liquid at least in the area or areas which align with the permeable area or areas of the wrapper. This allows the liquid to be transferred to the outer surface of the smoking article. Preferably, the wrapper is on the outermost surface of the smoking article. This ensures that the liquid transfer area or areas are well defined for the consumer.

The wrapper may be printed, embossed, debossed or otherwise embellished with manufacturer or brand logos, trade marks, slogans and other consumer information and indicia. In a preferred embodiment, the outer surface of the wrapper is printed, embossed, debossed or otherwise embellished with manufacturer or brand logos, trade marks, slogans and other consumer information and indicia, and the inner surface of the wrapper is partially coated with an impermeable coating, as discussed herein.

Most preferably, the aerosol forming substrate comprises a tobacco rod, the mouthpiece comprises a filter, and the wrapper comprises tipping material attaching the tobacco rod and the filter. Since the tipping material is at the outermost surface of the smoking article, this ensures that the liquid transfer area or areas are well defined for the consumer.

Typically, the tipping material surrounds the filter and a downstream portion of the tobacco rod adjacent the filter. The tipping material holds the filter and the tobacco rod together and is usually secured with adhesive. The tipping material is typically provided over one or more filter wrappers surrounding the filter and a tobacco rod wrapper surrounding the tobacco rod. In that case, any areas of the filter wrapper or tobacco rod wrapper which align with the permeable area or areas of the tipping material should be permeable to the liquid. This allows the liquid to be transferred to the outer surface of the smoking article, for example to the consumer's skin. Areas of the filter wrapper or tobacco rod aligned with the impermeable area or areas of the tipping material may be permeable or impermeable to the liquid.

If the smoking article comprises tipping material (whether or not the wrapper comprises the tipping material), the tipping material may include a ventilation zone comprising perforations through the tipping material. The tipping material may include at least one row of perforations to provide ventilation of the mainstream smoke. If the filter includes a filter wrapper, preferably, the perforations extend through the filter wrapper. Alternatively, the filter wrapper may be permeable. The number, size and position of the perforations may be selected to provide the desired level of ventilation.

Preferably, the perforations are upstream of the liquid delivery member and the at least one permeable area of the tipping material. This reduces the chance of leakage of the liquid through the perforations. The liquid preferably migrates to the outer surface of the smoking article only at the desired liquid transfer area or areas.

In one embodiment, the permeable area or areas of the wrapper form a pattern and, when the liquid is released from the structural material of the liquid delivery member, the liquid forms the pattern on an outer surface of the smoking article.

The area or areas on the outer surface of the smoking article where the liquid is transferred are referred to as liquid transfer areas. Thus, in this embodiment, the liquid transfer area or areas form a pattern. The pattern provides a well defined, predetermined and customized liquid transfer area or areas. In the case of liquid flavourant, the pattern may also provide the consumer with a clear indication of where flavour may be optimally transferred to the consumer's skin. If the liquid is visible to the consumer, this provides a new and stimulating visual experience for the consumer. This may be particularly effective if the outer surface of the smoking article and the liquid have contrasting colours.

The term "pattern" is used to refer to a discrete element, or repeating elements, which is or are non-randomly positioned. The pattern may be continuous or non-continuous. The pattern may be in the form of geometric shapes, images, logos, emblems, decorations or a combination thereof. The pattern may comprise a brand or manufacturer logo. The pattern may include material allowing a consumer to access further information. For example, the pattern may include a data matrix or barcode. The pattern may comprise text. The text may comprise one or more of letters, numbers and words. For example, the text may form a message to the consumer. The text may include material allowing a consumer to access further information. For example, the text may include details of a website, telephone number or email address.

If the wrapper is printed, embossed, debossed or otherwise embellished with manufacturer or brand logos, trade marks, slogans and other consumer information and indicia and if the liquid forms a pattern on the outer surface of the smoking article when the liquid is released, the liquid transfer areas and the printed, embossed, debossed or otherwise embellished areas of the wrapper may together convey information to the consumer.

The position of the permeable area or areas of the wrapper may be selected as desired. For example, the position of the permeable and impermeable areas may be positioned such that the liquid can only migrate to the outer surface of the smoking article at a desired location or locations. Migration of the liquid is prevented at other locations.

At least a portion of the at least one permeable area is aligned with or downstream of the liquid delivery member. However, preferably, the whole of the at least one permeable area is aligned with or downstream of the liquid delivery member. This may enhance transfer of the liquid to the permeable areas, since migration of the liquid in the downstream direction is more likely than migration of the liquid in the upstream direction.

For example, the wrapper may surround at least the mouth end of the smoking article and the furthest downstream end of the wrapper may be impermeable to the liquid. That is, the liquid cannot migrate to the outer surface of the smoking article at the furthest downstream end. This may prevent transfer of the liquid, for example liquid flavourant, to a consumer's lips, when the consumer is smoking the smoking article.

Preferably, the wrapper surrounds the mouthpiece and an adjacent portion of the aerosol forming substrate, and the portion of the wrapper surrounding the furthest upstream end of the mouthpiece is impermeable to the liquid. In a preferred embodiment, the aerosol forming substrate comprises a tobacco rod, the mouthpiece comprises a filter, the wrapper surrounds the filter and an adjacent portion of the tobacco rod, and the portion of the wrapper surrounding the furthest upstream end of the filter is impermeable to the liquid. This may be the case if the wrapper comprises tipping material attaching the filter and the tobacco rod. This may prevent transfer of the liquid to the outer surface of the smoking article in the region where the tipping material is securely attached to the tobacco rod. This may reduce the chance of the liquid diluting or breaking down the tipping material adhesive.

Alternatively or additionally, the wrapper may surround the mouthpiece and an adjacent portion of the aerosol forming substrate, and the portion of the wrapper surrounding the aerosol forming substrate may be at least partially permeable to the liquid. Preferably, the aerosol forming substrate comprises a tobacco rod, the mouthpiece comprises a filter, the wrapper surrounds the filter and an adjacent portion of the tobacco rod, and the portion of the wrapper surrounding the tobacco rod is at least partially permeable to the liquid. This may be the case if the wrapper comprises tipping material attaching the filter and the tobacco rod. This may be particularly advantageous if the wrapper is partially coated with an impermeable coating because the permeable area surrounding the tobacco rod will not be entirely coated. Preferably, the portion of the wrapper surrounding the tobacco rod is entirely uncoated. Thus, the coating should not affect the adhesion of the tipping material to the tobacco rod. In addition, if the wrapper comprises a die-cut or perforated impermeable material, the portion of the wrapper surrounding the aerosol forming substrate, for example tobacco rod, may include one or more apertures.

In addition, if the filter comprises a multi component filter comprising a plurality of filter segments, preferably, the portion of the wrapper surrounding the end of the filter segment containing the liquid delivery member adjacent another filter segment is impermeable to the liquid. This may prevent transfer of the liquid to the outer surface of the smoking article in the region where the two filter segments are attached. This may reduce the chance of the liquid diluting or breaking down any adhesive joining the two components.

Preferably, the at least one permeable area comprises at least about 5% of the surface area of the wrapper. More preferably, the at least one permeable comprises at least about 10% of the surface area of the wrapper. Preferably, the at least one permeable area comprises no more than about 30% of the surface area of the wrapper. More preferably, the at least one permeable area comprises no more than about 20% of the surface area of the wrapper. The inventor has found that this provides a suitable liquid transfer area on the outer surface of the smoking article, for example to allow flavour to be transferred to the consumer's fingers.

As already discussed, preferably the liquid delivery member is arranged to release the liquid when the smoking article is subject to external force. This allows the liquid to be controllably released by a consumer. The external force may be applied, and hence the liquid released, prior to, during or after use of the smoking article. The external force may be exerted in any direction, but is preferably exerted in a direction perpendicular to the longitudinal direction of the smoking article. This provides a squeezing or compression force on the liquid delivery member which allows the liquid to be released.

When the liquid is released, the liquid is able to migrate through the permeable portions of the wrapper to the outer surface of the smoking article. Then, when the liquid transfer areas come into contact with a consumer's skin, for example the consumer's fingers, if the liquid comprises liquid flavourant, the flavour of the liquid flavourant may be imparted onto the consumer's skin. The consumer may enhance transfer of the liquid flavourant onto the fingers by rubbing or squeezing the liquid transfer areas. This allows the flavour to be applied to the skin, under control of the consumer. For this purpose, the external force may be applied, and hence the liquid flavourant released, prior to, during or after use of the smoking article.

The liquid may comprise a liquid flavourant suitable for interacting with and modifying the characteristics of the smoking article and thus the smoke derived therefrom. For example, the liquid may impart a flavour to enhance the taste of the mainstream smoke produced during smoking. In that case, when the liquid flavourant is released, the consumer may experience a new smoking sensation due to the modified mainstream smoke. This may be advantageous because a single liquid delivery member may provide flavour for the mainstream smoke and flavour for a consumer's fingers. For this purpose, the external force may be applied, and hence the liquid flavourant released, prior to or during use of the smoking article.

The liquid delivery member may have any suitable structure in which a structural material releasably encloses a liquid or liquids. The liquid delivery member may comprise a matrix structure defining a plurality of domains, the liquid being trapped within the domains until released, for example, when the smoking article is subject to external force. More preferably, however, the liquid delivery member comprises a capsule. Preferably, the capsule comprises an outer shell and an inner core containing the liquid. Preferably, the outer shell is sealed before the application of an external force, but is frangible or breakable to allow the liquid to be released when the external force is applied. The capsule may be formed in a variety of physical formations including, but not limited to, a single-part capsule, a multi-part capsule, a single-walled capsule, a multi-walled capsule, a large capsule, and a small capsule.

If the liquid delivery member comprises a matrix structure defining a plurality of domains enclosing the liquid, the liquid delivery member may release the liquid steadily when the smoking article is subject to external force. Alternatively, if the liquid delivery member is a capsule arranged to rupture or burst to release the liquid when the smoking article is subject to external force (for example, but not limited to, if the capsule comprises an outer shell and an inner core), the capsule may have any desired burst strength. The burst strength is the force (exerted on the capsule from the outside of the smoking article) at which the capsule will burst. The burst strength may be a peak in the capsule's force versus compression curve.

The liquid delivery member may have any suitable shape, for example, spherical, spheroid, or ellipsoid. Preferably, however, the liquid delivery member is generally spherical. The generally spherical liquid delivery member may comprise a generally spherical outer shell.

The liquid delivery member may have any desired size. For example, the liquid delivery member may be spherical with a diameter between about 2.5 mm and about 4.5 mm, preferably between about 3.0 mm and about 3.5 mm, more preferably about 3.5 mm. The size of the liquid delivery member relative to the diameter of the smoking article should be appropriate so that a consumer can apply an external force to the smoking article in order to release the liquid from the liquid delivery member. The size of the liquid delivery member relative to the diameter of the smoking article should also be appropriate so that the liquid may migrate to the outer surface of the smoking article. For example, the liquid delivery member may be used in a smoking article having a diameter of between about 5.0 mm and about 8.0 mm, or between about 7.0 mm and about 8.0 mm (for example, standard cigarettes), or between about 5.0 mm and about 7.0 mm (for example, slim or super slim cigarettes).

In one embodiment, a cross sectional area of the liquid delivery member measured perpendicular to the longitudinal direction of the smoking article is about 20%, or greater, of the cross sectional area of the smoking article. In another embodiment, a cross sectional area of the liquid delivery member measured perpendicular to the longitudinal direction of the smoking article is about 30%, or greater, of the cross sectional area of the smoking article. In another embodiment, a cross sectional area of the liquid delivery member measured perpendicular to the longitudinal direction of the smoking article is about 45%, or greater, of the cross sectional area of the smoking article. In another embodiment, a cross sectional area of the liquid delivery member measured perpendicular to the longitudinal direction of the smoking article is about 55%, or greater, of the cross sectional area of the smoking article. The cross sectional area of the liquid delivery member measured perpendicular to the longitudinal direction of the smoking article may also be less than about 80%, of the cross sectional area of the smoking article.

The liquid delivery member may comprise any suitable material or combination of materials, for example those used in capsules for drug delivery, liquid encapsulated capsules, or other encapsulated materials. By way of example, a liquid delivery member typically utilized in the pharmaceutical industry may be used. Such liquid delivery members may be gelatin based, for example, or may be formed from a polymeric material, such as modified cellulose. One type of modified cellulose which may be used is hydroxypropylmethyl cellulose. In addition to gelatin or modified cellulose, or in addition to both gelatin and modified cellulose, the outer shell may comprise polysaccharide.

The liquid delivery member may be manufactured according to any suitable method (for example, by co-extrusion), as will be appreciated by those skilled in the art.

If the liquid comprises liquid flavourant, the liquid flavourant may comprise any flavour compound suitable for being releasably disposed in liquid form within the structural material of the liquid delivery member. The liquid flavourant is preferably suitable for imparting a flavour onto a consumer's skin, for example the consumer's fingers. The term "flavour" used throughout this specification, should be interpreted to include a gustatory sensation (taste), an olfactory sensation (smell), or both a gustatory sensation and an olfactory sensation. For example, the flavourant may impart a taste onto a consumer's fingers or into the mainstream smoke to enhance the mainstream smoke, or both. Alternatively or additionally, the flavourant may impart a fragrance onto a consumer's fingers, for example a fresh fragrance after smoking, or into the mainstream smoke, or both.

Suitable flavours or flavourings include, but are not limited to, menthol, mint, such as peppermint and spearmint, eucalyptus, sage, chocolate, liquorice, citrus and other fruit flavours, gamma octalactone, vanillin, ethyl vanillin, breath freshener flavours, spice flavours such as cinnamon, methyl salicylate, linalool, bergamot oil, geranium oil, lemon oil, ginger oil, and tobacco flavour. Other suitable flavours may include flavour compounds selected from the group consisting of an acid, an alcohol, an ester, an aldehyde, a ketone, a pyrazine, combinations or blends thereof and the like.

The liquid may be invisible to a consumer. For example, the liquid may be a colourless liquid. Preferably, however, the liquid is visible to a consumer. Then, when the liquid migrates through the permeable areas of the wrapper, the liquid is visible to the consumer at the liquid transfer area or areas. For example, the liquid may stain part of the outer surface of the smoking article. The liquid may therefore provide a new sensory effect, in the form of a new visual experience for the consumer.

For example, the liquid may be coloured. In order to enhance the new visual experience, the outer surface of the smoking article at which the liquid transfer area or areas are located, may comprise a colour which contrasts the colour of the liquid. For example, if the wrapper comprises tipping material, the tipping material may be a colour which contrasts with the colour of the liquid. For example, the tipping paper may be white, or another neutral colour.

The mouthpiece may comprise a filter including filtration material for filtering the mainstream smoke. If the mouthpiece comprises a filter, the filter may comprise any suitable filter material or materials. Examples of suitable materials include, but are not limited to, cellulose acetate, cellulose, reconstituted cellulose, polylactic acid, polyvinyl alcohol, nylon, polyhydroxybutyrate, polypropylene, paper, thermoplastic material, such as starch, non-woven materials, and combinations thereof. One or more of the materials may be formed into an open cell structure. Preferably, the filter material comprises cellulose acetate tow.

The filter may include additional material, for example, incorporated into fibrous filter tow of the filter. For example, the filter may include a sorbent material. The term "sorbent" refers to either an adsorbent, an absorbent, or a substance that may perform both of these functions. The sorbent material may comprise activated carbon. Preferably, the sorbent is incorporated into a filter element upstream of the liquid delivery member. Such an arrangement allows for the filtration of the smoking article to be effected by the sorbent, and for the liquid to be released into the filter without the any effect of the liquid, for example provision of flavour, being affected by absorption or adsorption by the sorbent.

Alternatively or additionally, the filter may include an adhesive, a plasticiser, a flavour release agent, such as flavoured cellulose thread, sepiolite, molecular sieves or activated carbon impregnated with flavours, or a combination thereof. The filter may include a filter wrapper circumscribing the filter material.

If the mouthpiece comprises a filter, the filter may be a multi component filter comprising a plurality of filter segments. The plurality of filter segments may include a plug or plugs of filter material, for example cellulose acetate tow, a disc or discs of filter material, for example cellulose acetate tow, a hollow tube or tubes, one or more spaces or cavities which may be empty or filled with any suitable material, or a combination thereof. The plurality of filter segments are preferably axially aligned with each other and with the aerosol forming substrate, such as a tobacco rod. Exemplary filter structures that may be used include, but are not limited to, a mono filter, a dual filter, a triple filter, a single or multi cavity filter, a recessed filter, a free-flow filter, and combinations thereof. Mono filters typically contain cellulose acetate tow or cellulose paper materials. Dual filters typically comprise a cellulose acetate mouth end and a pure cellulose or cellulose acetate segment. Cavity filters include at least two segments, for example, acetate-acetate, acetate-paper or paper-paper, separated by at least one cavity. Recessed filters include an open cavity at the mouth end.

If the filter comprises a multi component filter, each filter segment may comprise a filter wrapper circumscribing the filter material of the segment. Additionally or alternatively, the filter may comprise a filter wrapper circumscribing the whole filter. The wrapper having at least one area permeable to the liquid and at least one area impermeable to the liquid may comprise one such filter wrapper, or may be provided in addition to such filter wrappers. In one embodiment, the filter is a multi component filter comprising a plurality of filter segments, the liquid delivery member is disposed in one of the filter segments, the filter comprises a filter wrapper circumscribing each filter segment and a filter wrapper circumscribing the whole filter, the aerosol forming substrate comprises a tobacco rod, and the wrapper comprises tipping material on the outside of the filter wrappers attaching the tobacco rod and the filter. In a preferred embodiment, the filter is a multi-component filter comprising an upstream filter segment including filter material and a filter wrapper surrounding the filter material; a downstream filter segment including filter material and a filter wrapper surrounding the filter material; and a filter wrapper circumscribing the upstream and downstream filter segments, the liquid delivery member is disposed in the upstream filter segment, the aerosol forming substrate comprises a tobacco rod, and the wrapper comprises tipping material on the outside of the filter wrappers, attaching the tobacco rod and the filter.

If the aerosol forming substrate comprises a tobacco rod, the tobacco rod typically comprises a paper wrapper in which tobacco material is wrapped. Adhesive generally holds the seams of the paper wrapper together. The tobacco rod has a first, downstream end which is attached to the mouthpiece and a second, upstream end which is lit or heated for smoking the tobacco. When the tobacco rod is lit or heated for smoking, the smoke travels from the lit end downstream to the mouthpiece end of the tobacco rod and further downstream through the mouthpiece.

Examples of suitable types of tobacco materials that may be used include, but are not limited to, flue-cured tobacco, Burley tobacco, Maryland tobacco, Oriental tobacco, rare tobacco, specialty tobacco, blends thereof and the like. The tobacco material may be provided in any suitable form, including, but not limited to, tobacco lamina, processed tobacco materials, such as volume expanded or puffed tobacco, processed tobacco stems, such as cut-rolled or cut-puffed stems, reconstituted tobacco materials, blends thereof, and the like. Tobacco substitutes may also be used. In traditional cigarette manufacture, the tobacco is normally used in the form of cut filler, that is, in the form of shreds or strands cut into widths ranging from about 2.5 mm to about 1.2 mm or even about 0.6 mm. The lengths of the strands range from between about 6 mm to about 75 mm.

According to the first aspect of the invention, there is further provided a smoking article comprising: a tobacco rod comprising a tobacco rod wrapper surrounding tobacco material; a filter axially aligned with the tobacco rod, the filter comprising at least one filter wrapper surrounding filter material; a liquid delivery member disposed in the filter, the liquid delivery member comprising structural material releasably enclosing liquid; and tipping material attaching the tobacco rod and the filter, wherein the tipping material is partially coated with a coating impermeable to the liquid, thereby producing at least one coated area and at least one uncoated area, and wherein at least a portion of the at least one uncoated area of the tipping material is aligned with or downstream of the liquid delivery member.

According to the first aspect of the invention, there is further provided a smoking article comprising: a tobacco rod comprising a tobacco rod wrapper surrounding tobacco material; a filter axially aligned with the tobacco rod, the filter comprising at least one filter wrapper surrounding filter material; a flavour delivery member disposed in the filter, the flavour delivery member comprising structural material releasably enclosing liquid flavourant; and tipping material attaching the tobacco rod and the filter, wherein the tipping material is partially coated with a coating impermeable to the liquid flavourant, thereby producing at least one coated area and at least one uncoated area, and wherein at least a portion of the at least one uncoated area of the tipping material is aligned with or downstream of the flavour delivery member.

The smoking article of the first aspect of the invention may be manufactured using standard apparatus and techniques. The wrapper may be pre-formed with permeable and impermeable areas, and then fed into regular manufacturing machinery. In this way, no adaptations to modern, high speed machinery need to be made in order to take advantage of the present invention.

According to a second aspect of the invention, there is provided a filter for a smoking article, the filter comprising: filter material; a liquid delivery member comprising structural material releasably enclosing liquid; and a filter wrapper surrounding at least a portion of the filter material, wherein the filter wrapper includes at least one area permeable to the liquid and at least one area impermeable to the liquid, and wherein at least a portion of the at least one permeable area of the filter wrapper is aligned with or downstream of the liquid delivery member.

According to the second aspect of the invention, the liquid delivery member is disposed in the filter. The filter may be attached to a tobacco rod with tipping material. The liquid delivery member is preferably arranged to release at least a portion of the liquid when the filter is subject to external force. The liquid is able to migrate through the permeable area or areas of the filter wrapper to the outer surface of the filter, for example to release flavour onto the fingers of a consumer. Features described in relation to the first aspect of the invention, in embodiments in which the wrapper having areas permeable to the liquid and areas impermeable to the liquid may comprise a filter wrapper, may also be applicable to the second aspect of the invention.

The liquid delivery member may have any suitable structure in which a structural material releasably encloses a liquid or liquids. The liquid may comprise any suitable substance, but preferably comprises liquid flavourant. The liquid flavourant may comprise any flavour compound suitable for being releasably disposed in liquid form within the structural material of the liquid delivery member. Preferably, the liquid flavourant is suitable for imparting a flavour onto a consumer's skin, for example the consumer's fingers. This is advantageous because the consumer is most likely to touch the filter portion of the smoking article before and during smoking.

The filter material may comprise any suitable filter material or materials. The liquid delivery member may be embedded in the filter material of the filter, for example in a plug of filter material, such as cellulose acetate tow. Alternatively, the liquid delivery member may be provided in a cavity within the filter, for example in a plug-space-plug filter.

The filter may be a multi component filter comprising a plurality of filter segments. Each filter segment may comprise a filter wrapper circumscribing the filter material of the segment. Additionally or alternatively, the filter may comprise a filter wrapper circumscribing the whole filter. The filter wrapper having at least one permeable area and at least one impermeable area may comprise one such filter wrapper, or may be provided in addition to such filter wrappers.

In a preferred embodiment, the filter comprises: an upstream filter segment comprising filter material and an upstream filter wrapper surrounding the filter material; and a downstream filter segment comprising filter material and a downstream filter wrapper surrounding the filter material, wherein the liquid delivery member is disposed in the upstream filter segment, and wherein the filter wrapper surrounds both the upstream and the downstream filter segments.

Preferably, the filter wrapper is partially coated with a coating impermeable to the liquid, such that the uncoated area or areas comprise the at least one area permeable to the liquid and the coated area or areas comprise the at least one area impermeable to the liquid. The coating may be any coating suitable for rendering the filter wrapper impermeable to the liquid.

The position of the permeable area or areas of the filter wrapper may be selected as desired. For example, the filter wrapper may surround at least the mouth end of the filter and the furthest downstream end of the filter wrapper may be impermeable to the liquid. This may prevent transfer of the liquid to a consumer's lips. Alternatively or additionally, the filter wrapper may surround at least the furthest upstream end of the filter and the furthest upstream end of the filter wrapper may be impermeable to the liquid. When the filter is attached to a tobacco rod, or another aerosol forming substrate, this may prevent transfer of the liquid to the outer surface of the smoking article in the region of the tobacco rod-filter interface. Alternatively or additionally, if the filter comprises a multi component filter comprising a plurality of filter segments, preferably, the portion of the filter wrapper surrounding the end of the filter segment containing the liquid delivery member adjacent another filter segment is impermeable to the liquid. This may prevent transfer of the liquid to the outer surface of the smoking article in the region where the two filter segments are attached.

Preferably, the at least one permeable area comprises at least about 5% of the surface area of the filter wrapper. More preferably, the at least one permeable area comprises at least about 10% of the surface area of the filter wrapper. Preferably, the at least one permeable area comprises no more than about 30% of the surface area of the filter wrapper. More preferably, the at least one permeable area comprises no more than about 20% of the surface area of the filter wrapper.

The liquid delivery member may have any desired shape. The liquid delivery member may have any desired size. The liquid delivery member may comprise any suitable material or combination of materials. The liquid delivery member may be manufactured according to any suitable method. The liquid may comprise any compound suitable for being releasably disposed in liquid form within the structural material of the liquid delivery member.

According to a third aspect of the invention, there is provided a wrapper for a smoking article, the smoking article including a liquid delivery member comprising structural material releasably enclosing liquid, the wrapper comprising: at least one area permeable to the liquid and at least one area impermeable to the liquid, wherein the wrapper is configured to surround at least a portion of the smoking article such that at least a portion of the at least one permeable area of the wrapper is aligned with or downstream of the liquid delivery member in the smoking article.

Preferably, the wrapper is partially coated with a coating impermeable to the liquid, such that the uncoated area or areas comprise the at least one area permeable to the liquid and the coated area or areas comprise the at least one area impermeable to the liquid. The coating may be any coating suitable for rendering the wrapper impermeable to the liquid.

The wrapper may be provided in addition to other wrappers of the smoking article. Preferably, the wrapper is for wrapping the outermost surface of the smoking article.

The smoking article preferably includes a tobacco rod and a filter axially aligned with the tobacco rod and the liquid delivery member is preferably disposed in the filter. The wrapper may be a filter wrapper for surrounding all or part of the filter. If the filter is a multi component filter comprising a plurality of filter segments, the wrapper may be a wrapper for an individual filter segment or a wrapper for the whole filter.

Preferably, however, the smoking article comprises a tobacco rod and a filter axially aligned with the tobacco rod, the liquid delivery member is disposed in the filter, and the wrapper comprises tipping material for attaching the tobacco rod and the filter. Preferably, the tipping material is configured to surround the filter and a downstream portion of the tobacco rod adjacent the filter. The permeable areas of the tipping material are positioned such that, when the tipping material is wrapped over the filter and the tobacco rod, the at least one permeable area of the tipping material is aligned with or downstream of the liquid delivery member in the filter.

Preferably, the tipping material includes perforations positioned upstream of the liquid delivery member and the at least one permeable area of the tipping material when the tipping material is wrapped over the filter and the tobacco rod.

The wrapper of the third aspect of the invention may be manufactured using engraved rotogravure cylinders, as will be appreciated by those skilled in the art. The wrapper may then be fed into standard manufacturing machinery for manufacturing smoking articles.

Features described in relation to one aspect of the invention may also be applicable to another aspect of the invention. In particular, features described in relation to the first aspect of the invention, in embodiments in which the wrapper may comprise a filter wrapper, may also be applicable to the second aspect of the invention.

Figure 2:
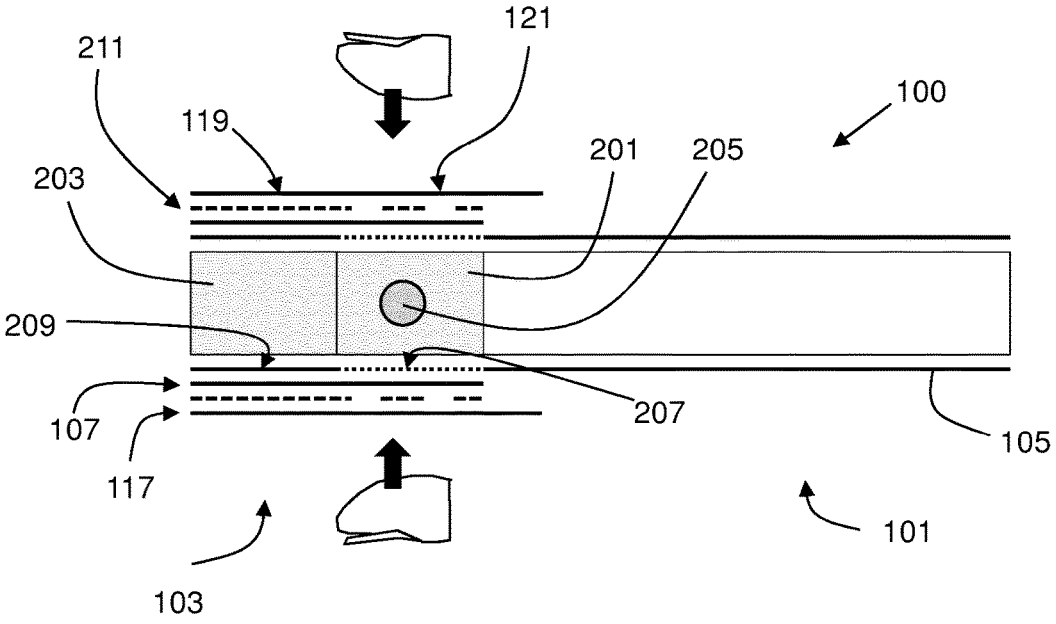

The invention will be further described, by way of example only, with reference to the accompanying drawings in which:

FIG. 1 is a perspective view of a smoking article according to an embodiment of the invention; and FIG. 2 is a schematic cross sectional view of the smoking article of FIG. 1.

FIG. 1 is a perspective view of a smoking article 100 according to an embodiment of the invention. The smoking article 100 includes an aerosol forming substrate in the form of a generally cylindrical tobacco rod 101 and a mouthpiece in the form of a generally cylindrical filter 103. The tobacco rod 101 and filter 103 are axially aligned in an end-to-end relationship, preferably abutting one another. The tobacco rod 101 includes an outer wrapper 105 circumscribing the smoking material. The outer wrapper 105 may be a porous wrapping material or paper wrapper. The tobacco is preferably a shredded tobacco or tobacco cut filler. The filter 103 includes a filter wrapper 107 circumscribing the filter material. The filter wrapper 107 may be a porous wrapping material or paper wrapper. The tobacco rod 101 has an upstream, lit end 109 and a downstream end 111. The filter 103 has an upstream end 113 and a downstream, mouth end 115. The upstream end 113 of the filter 103 is adjacent the downstream end 111 of the tobacco rod 101. Although not visible in FIG. 1, a liquid delivery member is disposed in the filter 103.

The filter 103 is attached to the tobacco rod 101 by tipping material 117 which circumscribes the entire length of the filter 103 and an adjacent region of the tobacco rod 101. The tipping material 117 is shown partially removed from the smoking article in FIG. 1, for clarity. The tipping material 117 is typically a paper like product. However, any suitable material can be used. The tipping material 117 includes areas 119 which are coated with an impermeable coating and areas 121 which are not coated with the impermeable coating. The coating will be discussed further below. The uncoated areas 121 are arranged in a pattern, in this case a pattern of diamonds. The pattern of uncoated areas is generally aligned with the liquid delivery member (not shown) disposed in the filter 103. In this embodiment, the tipping material 117 also includes a circumferential row of perforations 123 upstream of the uncoated areas 121 and the liquid delivery member (not shown) disposed in the filter. The perforations 123 are provided for ventilation of the mainstream smoke.

In this specification, the "upstream" and "downstream" relative positions between smoking article components are described in relation to the direction of mainstream smoke as it is drawn from the tobacco rod 101 and through the filter 103.

FIG. 2 is a schematic cross sectional view of the smoking article of FIG. 1. As described in relation to FIG. 1, the smoking article 100 includes a tobacco rod 101 and a filter 103. The tobacco rod 101 includes an outer wrapper 105 which is shown separated from the tobacco material in FIG. 2, for clarity. The filter 103 comprises an upstream filter segment 201 and a downstream filter segment 203 adjacent to and downstream of filter segment 201. Upstream filter segment 201 includes a liquid delivery member in the form of a flavour capsule 205. The capsule 205 comprises an outer shell and an inner core enclosing liquid flavourant (not shown). In this embodiment, the capsule 205 is embedded in the filter material of the filter segment 201. Upstream filter segment 201 is wrapped with a porous filter wrapper 207, which is shown separated from the filter in FIG. 2, for clarity. Downstream filter segment 203 is wrapped with a standard non-porous filter wrapper 209, which is also shown separated from the filter in FIG. 2, for clarity. The entire filter 103 is then overwrapped with filter wrapper 107 (as also shown in FIG. 1). The filter wrapper 107 is also shown separated from the filter in FIG. 2, for clarity.

As described in relation to FIG. 1, the filter 103 is attached to the tobacco rod 101 by tipping material 117. The inner surface of the tipping material 117 is partially coated with an impermeable coating 211, shown schematically in FIG. 2. As already described, areas 119 of the tipping material are coated with the impermeable coating 211 and areas 121 are not coated with the impermeable coating 211. The uncoated areas 121 are arranged in a pattern which is generally longitudinally aligned with the capsule 205 disposed in the filter segment 201. The tipping material 117 also includes a circumferential row of perforations 123 upstream of the capsule 205, although this is not shown in FIG. 2, for clarity.

In use, the capsule 205 releases at least a portion of the liquid flavourant enclosed in its inner core when the smoking article 100 is subject to external force, for example by a consumer squeezing the filter 103. This is shown schematically in FIG. 2. When the liquid flavourant is released, it is able to migrate through the porous filter wrapper 207 and through filter wrapper 107. The impermeable coating 211 is any coating which renders the tipping material 117 impermeable to the liquid flavourant. Thus, the coated areas 119 of the tipping material 117 are impermeable to the liquid flavourant, but the uncoated areas 121 are permeable to the liquid flavourant. Thus, the liquid flavourant is able to migrate only through uncoated areas 121 to the outer surface of the smoking article 100. The flavour may then be transferred to the consumer's fingers whenever the consumer touches the uncoated areas of the tipping material 117 on the outer surface of the filter 103. The external force may be applied, and hence the liquid flavourant released, before, during or after smoking.

In the embodiment illustrated in FIGS. 1 and 2, the liquid flavourant is red and the tipping material 117 is white. Therefore, when the liquid flavourant migrates to the outer surface of the smoking article 100 (once the consumer has squeezed the filter 103), a diamond pattern of red staining, corresponding to the diamond pattern of uncoated areas 121 on the tipping material 117, appears on the outer surface of the smoking article 100. The pattern provides a new and stimulating visual experience for the consumer, and also provides a well defined, clear indication of where flavour may be optimally transferred to the consumer's skin. Any suitable pattern of uncoated areas may alternatively be provided.

In the embodiment illustrated in FIGS. 1 and 2, the upstream filter segment 201 is 12 mm in length, the diameter of the capsule 205 is 3.5 mm and the downstream filter segment 203 is 15 mm in length. The tipping material 117 is 32 mm in length so circumscribes the entire length of the filter 103 and a 5 mm adjacent region of the tobacco rod 101. The uncoated areas 121 of the tipping material 117 may extend across any length, but preferably have a total length less than that of the upstream filter segment 201. Preferably, the furthest upstream end of the filter segment 201 is circumscribed by a coated area 119 of the tipping material 117. This prevents undesired migration of the liquid flavourant to the outer surface of the smoking article at the interface between filter segment 201 and tobacco rod 101. This prevents the liquid flavourant affecting adhesive securing the tipping material 117 to the tobacco rod 101. In addition, the portion of the tipping material 117 which extends over the tobacco rod 101 is preferably not coated. This prevents the coating affecting adhesive securing the tipping material 117 to the tobacco rod 101. In addition, preferably, the furthest downstream end of the filter segment 201 is circumscribed by a coated area 119 of the tipping material 117. This prevents undesired migration of the liquid flavourant to the outer surface of the smoking article at the interface between filter segment 201 and filter segment 203. This prevents the liquid flavourant affecting any adhesive securing the filter segments 201, 203 to one another. In addition, the mouth end of the tipping material 117 is coated with the impermeable coating 211. This prevents undesired transfer of flavour onto the consumer's lips during smoking of the smoking article. Finally, because the perforations 123 are upstream of capsule 205, there is little chance of the liquid flavourant leaking out of the perforations. Thus, the location of the liquid transfer areas on the outer surface of the smoking article are predetermined and well defined.

The invention claimed is:

1. A smoking article comprising:

an aerosol forming substrate;

a mouthpiece axially aligned with the aerosol forming substrate;

a liquid delivery member disposed in the aerosol forming substrate or in the mouthpiece, the liquid delivery member comprising structural material releasably enclosing liquid;

a wrapper surrounding at least a portion of the smoking article, and a coating impermeable to the liquid and partially coating the wrapper, the partially coated wrapper comprising an uncoated area including at least one area permeable to the liquid and a coated area including at least one area impermeable to the liquid, wherein at least a portion of the at least one permeable area is aligned with or downstream of the liquid delivery member.

2. A smoking article according to claim 1, wherein the liquid comprises liquid flavourant.

3. A smoking article according to claim 1, wherein the liquid delivery member is disposed in the mouthpiece.

4. A smoking article according to claim 1, wherein the aerosol forming substrate comprises a tobacco rod, the mouthpiece comprises a filter, and the wrapper comprises tipping material attaching the tobacco rod and the filter.

5. A smoking article according to claim 4, wherein the tipping material comprises perforations upstream of the liquid delivery member and the at least one permeable area.

6. A smoking article according to claim 1, wherein the permeable area or areas of the wrapper form a pattern and, when the liquid is released from the structural material of the liquid delivery member, the liquid forms the pattern on an outer surface of the smoking article.

7. A smoking article according to claim 1, wherein the wrapper surrounds at least the mouth end of the smoking article and the furthest downstream end of the wrapper is impermeable to the liquid.

8. A smoking article according to claim 1, wherein the aerosol forming substrate comprises a tobacco rod, the mouthpiece comprises a filter, the wrapper surrounds the filter and an adjacent portion of the tobacco rod, and the portion of the wrapper surrounding the furthest upstream end of the filter is impermeable to the liquid.

9. A smoking article according to claim 1, wherein the aerosol forming substrate comprises a tobacco rod, the mouthpiece comprises a filter, the wrapper surrounds the filter and an adjacent portion of the tobacco rod, and the portion of the wrapper surrounding the tobacco rod is at least partially permeable to the liquid.

10. A smoking article according to claim 1, wherein the at least one permeable area comprises between about 5% and about 30% of the surface area of the wrapper.

11. A smoking article according to claim 1, wherein the liquid is coloured.

12. A filter for a smoking article, the filter comprising:

filter material;

a liquid delivery member comprising structural material releasably enclosing liquid;

a filter wrapper surrounding at least a portion of the filter material, and a coating impermeable to the liquid and partially coating the filter wrapper, the partially coated filter wrapper comprising an uncoated area including at least one area permeable to the liquid and a coated area including at least one area impermeable to the liquid, wherein at least a portion of the at least one permeable area of the filter wrapper is aligned with or downstream of the liquid delivery member.

13. A filter according to claim 12, wherein the filter comprises:

an upstream filter segment comprising filter material and an upstream filter wrapper surrounding the filter material; and a downstream filter segment comprising filter material and a downstream filter wrapper surrounding the filter material, wherein the liquid delivery member is disposed in the upstream filter segment, and wherein the filter wrapper surrounds both the upstream and the downstream filter segments.

14. A smoking article comprising, a wrapper surrounding a liquid delivery member comprising structural material releasably enclosing liquid, the wrapper comprising:

wrapping material permeable to the liquid; and a coating impermeable to the liquid and partially coating the wrapping material, the partially coated wrapping material comprising an uncoated area including at least one area permeable to the liquid and a coated area including at least one area impermeable to the liquid, wherein the wrapper is configured to surround at least a portion of a smoking article such that at least a portion of the at least one permeable area of the wrapper is aligned with or downstream of the liquid delivery member in the smoking article.

15. A filter according to claim 12, wherein the liquid comprises liquid flavourant.

16. A smoking article according to claim 14, wherein the liquid comprises liquid flavourant.

17. A filter according to claim 12, wherein the at least one permeable area comprises between about 5% and about 30% of the surface area of the wrapper.

18. A smoking article according to claim 14, wherein the at least one permeable area comprises between about 5% and about 30% of the surface area of the wrapper.

19. A smoking article according to claim 11, wherein the coloured liquid contrasts a colour of the wrapper.

* * * * *